US005157936A

United States Patent [19]

Wall

[11] Patent Number: 5,157,936

[45] Date of Patent: Oct. 27, 1992

[54] METHOD AND APPARATUS FOR RECLAIMING REFRIGERANT

[76] Inventor: Frank N. Wall, 8886 W. Geddes Pl., Littleton, Colo. 80123

[21] Appl. No.: 735,424

[22] Filed: Jul. 25, 1991

[51] Int. Cl.[5] ..... F25B 45/00

[52] U.S. Cl. ..... 62/292; 62/77

[58] Field of Search ..... 62/292, 77, 149

[56] References Cited

U.S. PATENT DOCUMENTS

| | | | |
|---|---|---|---|
| 3,232,070 | 2/1966 | Sparano | 62/149 |
| 4,476,688 | 10/1984 | Goddard | 62/149 |
| 4,646,527 | 3/1987 | Taylor | 62/85 |
| 4,809,515 | 3/1989 | Houwink | 62/149 |
| 4,809,520 | 3/1989 | Manz et al. | 62/292 |
| 4,856,289 | 8/1989 | Lofland | 62/149 |
| 4,903,499 | 2/1990 | Merritt | 62/149 |
| 4,938,031 | 7/1990 | Manz et al. | 62/145 |
| 4,967,570 | 11/1990 | Van Steenburgh, Jr. | 62/292 |
| 4,981,020 | 1/1991 | Scuderi | 62/77 |
| 4,993,461 | 2/1991 | Yamane | 141/231 |
| 4,998,413 | 3/1991 | Sato et al. | 62/149 |
| 5,040,382 | 8/1991 | Abraham | 62/470 |

FOREIGN PATENT DOCUMENTS

| | | |
|---|---|---|
| 1189467 | 7/1989 | Japan . |
| 1196472 | 8/1989 | Japan . |

*Primary Examiner*—Albert J. Makay
*Assistant Examiner*—William C. Doerrler
*Attorney, Agent, or Firm*—John E. Reilly

[57] ABSTRACT

A high capacity refrigerant apparatus is made up of a heat exchanger which receives refrigerant from the system to be drained in heat exchange relation to a coolant from a vapor compressor circuit, and a liquid pump discharges the refrigerant from the heat exchanger so long as the liquid refrigerant in the heat exchanger remains at a particular level; otherwise, the refrigerant is drawn through a second vapor compressor circuit and completely condensed prior to discharge. In a modified form, a lower capacity refrigerant reclamation apparatus, a reciculating coolant tube vaporizes a limited amount of refrigerant and returns it back through the heat exchanger so as not to require a separate vapor compressor system for the heat exchange cooling medium.

17 Claims, 3 Drawing Sheets

METHOD AND APPARATUS FOR RECLAIMING REFRIGERANT

This invention relates to refrigerant recovery systems and more particularly relates to a novel and improved method and apparatus for the recovery of refrigerant from abandoned or operating refrigeration systems in a rapid and efficient manner.

BACKGROUND AND FIELD OF THE INVENTION

Numerous systems have been devised for the removal of refrigerants from refrigeration systems into storage cylinders or tanks. There has been increasing recognition that to permit the escape of the refrigerant, for example, by bleeding it into the atmosphere may adversely affect the ozone layer and otherwise be environmentally unsafe. A particular problem associated with the efficient removal of refrigerant from larger commercial systems is the ability to maintain as much of the refrigerant as possible in a liquid state for its rapid removal and to liquefy any of the refrigerant in a gaseous state through a compressor and condensor system without exposing the compressor to any of the liquid refrigerant.

U.S. Pat. No. 4,646,527 to Taylor employs discharged gas to heat the incoming refrigerant to boil off the refrigerant and remove the contaminants as opposed to allowing the refrigerant to remain in liquid form or to promote its liquefication prior to removal. U.S. Pat. No. 4,981,020 to Scuderi allows the liquid refrigerant to enter a receiver but there is no heat exchanger in the receiver and no means for pumping the liquid directly into the recovery tank or cylinder and relies instead on pressure differential to remove the refrigerant. Further, the liquid refrigerant is collected in one receiver and bypassed around the compressor section to another receiver then discharged by the discharge pressure of the compressor but does not either pump the liquid refrigerant or chill the refrigerant in the receiver. In U.S. Pat. No. 4,967,570 to Van Steenburgh, Jr., compressor gas is used to vaporize the refrigerant as opposed to keeping it chilled then converts into a liquid but does not use a heat exchanger to keep the incoming gas chilled by means of a separate compressor system. U.S. Pat. No. 4,993,461 to Yamane condenses the vaporized refrigerant but attempts to liquefy it in a recovery tank, and an accumulator is used to assist in reducing the compressor load.

In U.S. Pat. No. 4,809,520 to Manz et al, the heat exchanger is used to vaporize the refrigerant and a liquid pump is used to recycle the refrigerant but not to draw directly out of the system being drained. In U.S. Pat. No. 4,856,289 to Lofland, a pressure regulator is used to vaporize the refrigerant but does not employ a heat exchanger or other cooling medium nor does he employ a liquid pump which permits large amounts of refrigerant to be transferred in short periods of time.

It is therefore desirable to provide for an efficient removal or recovery system for refrigerant from large commercial systems as well as smaller systems which will maintain as much of the refrigerant as possible in liquid form and further will promote liquefication by immediate transfer to a heat exchanger so as to speed the recovery process by removing the liquid and creating a lower temperature source for the gaseous refrigerant. Further it is desirable to employ a heat exchanger utilizing the discharge gas to heat the incoming gas into the compressor so as to prevent liquid from reaching the compressor, an accumulator being used to prevent the liquid refrigerant from entering the compressor; and a crankcase pressure regulator at the inlet to the accumulator reduces the compressor load and enables the compressor to pump all types of refrigerant without damaging the compressor while permitting the gas to become fully liquefied in the condensor.

SUMMARY OF THE INVENTION

It is therefore an object of the present invention to provide for a novel and improved refrigerant reclamation system which is capable of draining refrigerant from large commercial and industrial refrigerant systems in a minimum amount of time.

Another object of the present invention is to provide for a novel and improved method and apparatus for reclaiming refrigerant either for the purpose of reuse or disposal and which is readily transportable to the site of removal and is highly dependable and efficient in operation.

It is another object of the present invention to provide in a refrigerant recovery system for a novel and improved heat exchanger for maintaining a maximum percentage of the refrigerant in liquid form for direct removal into a recovery tank; and further to provide for novel and improved means for chilling the refrigerant in the heat exchanger and to liquefy as much refrigerant as possible without passing through a compressor and condensor stage.

A further object of the present invention is to provide for a novel and improved method and apparatus for recovery of refrigerant which is economical to operate and is readily conformable for various different refrigerant recovery operations together with a novel and improved method and means for compressing and condensing any refrigerant in the gaseous state as a preliminary to removal.

In accordance with the present invention, a novel and improved reclamation apparatus has been devised for the recovery of refrigerant fluids from a refrigerant source which may, for example, be either an abandoned or operating refrigerant system in which it is necessary to drain the refrigerant from the system. The novel and improved apparatus of the present invention comprises a first heat exchanger having coolant means for directing a refrigerant cooling medium therethrough, inlet means for directing refrigerant from said source into said first heat exchanger in heat exchange relation to a cooling medium, liquid pumping means for discharging the refrigerant from the heat exchanger, sensing means for sensing the liquid level of the refrigerant in the first heat exchanger, the liquid pumping means being activated in response to the first heat exchanger being filled to a predetermined level, and condensor means for condensing refrigerant in gaseous form including means establishing communication between the condensor means and the first heat exchanger for delivering refrigerant from the first heat exchanger to the condensor means.

In the preferred form, a time delay is associated with the sensing means and will cause the sensing means to deactivate the liquid pumping means if the liquid level of refrigerant in the first heat exchanger remains below a predetermined level over a preset time period.

The cooling means may either take the form of a vapor compressor system having a thermal expansion valve and condensor for circulating cooling medium through the first heat exchanger or a recirculating coolant tube associated with the liquid pumping means to vaporize a limited amount of the refrigerant and recirculate it back through the first heat exchanger. Furthermore, a special receiver fill switch can be employed to adapt the preferred form of apparatus for use in removing refrigerant from the refrigerant source while it is being maintained or repaired and then returning it from the first heat exchanger back to the source.

Other objects, advantages and features of the present invention will become more readily appreciated and understood when taken together with the following detailed description of a preferred embodiment in conjunction with the accompanying drawings, in which:

DETAILED DESCRIPTION OF PREFERRED EMBODIMENT

Figure 1:
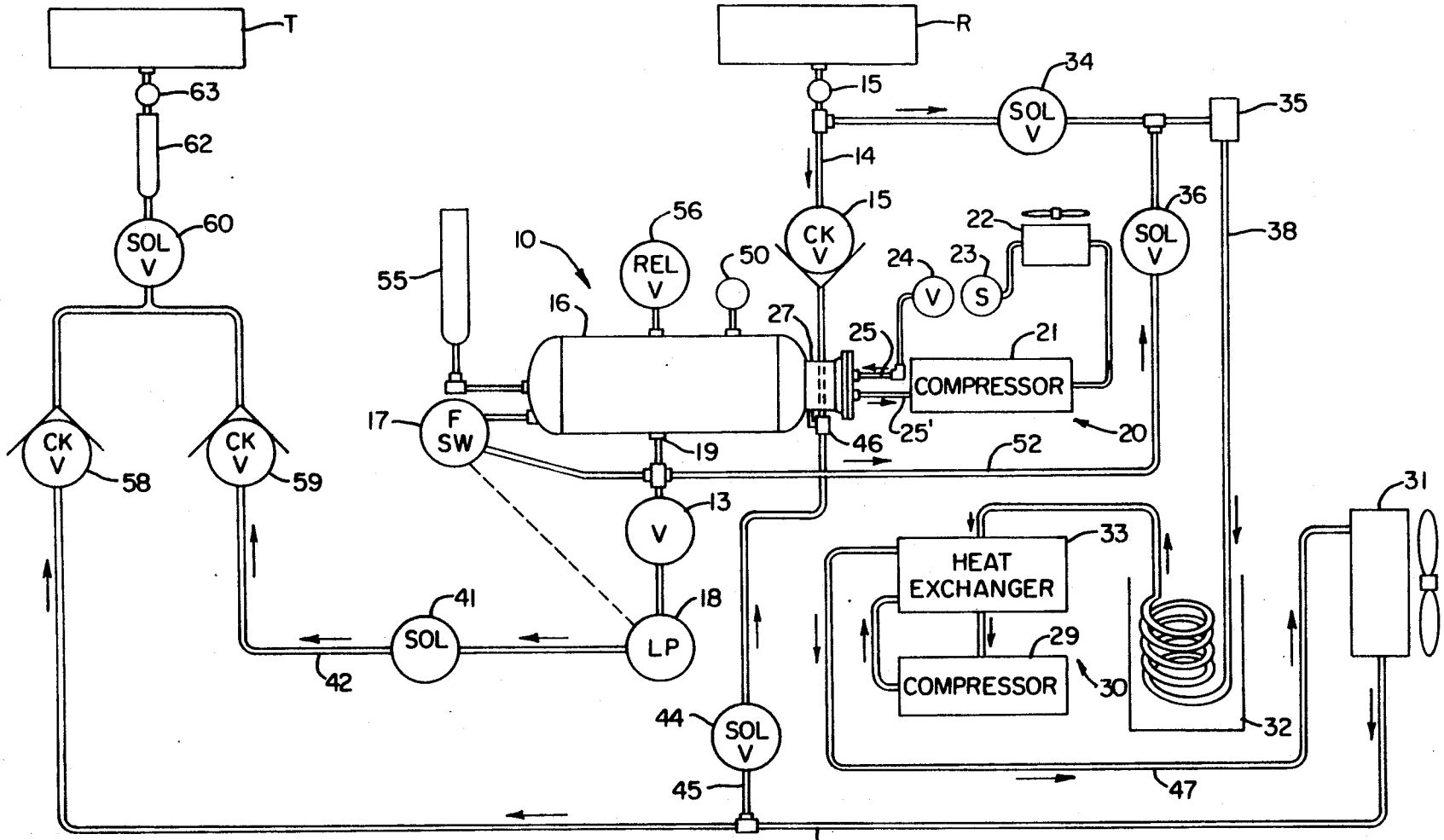
FIG. 1 is a somewhat schematic view of a preferred form of high capacity apparatus for reclaiming refrigerant.

Referring in detail to the drawings, a preferred form of apparatus 10 is shown in FIGS. 1 to 5 and can be mounted on casters or other wheeled platform 12. The apparatus 10 has an inlet line or conduit 14 including a moisture-indicating sight glass 15, the conduit 14 being adapted for connection to a refrigerant system R to be drained. A first heat exchanger or receiver 16 includes a float switch 17 which electrically controls a liquid pump 18 depending upon the liquid level in the receiver 16. An outlet line 19 communicates with the liquid pump 18 and a solenoid valve 13 is positioned in the line 19.

Figure 2:
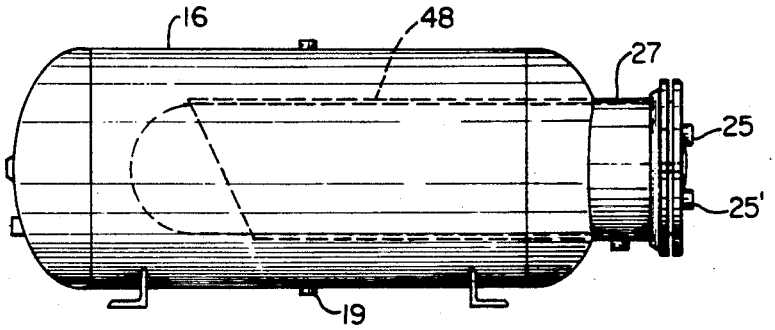
FIG. 2 is a side view in elevation of a preferred form of heat exchanger in accordance with the present invention.
Figure 3:
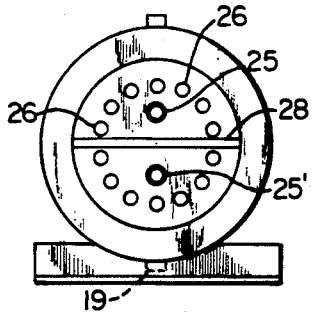
FIG. 3 is an end view of the heat exchanger shown in FIG. 2.
Figure 4:
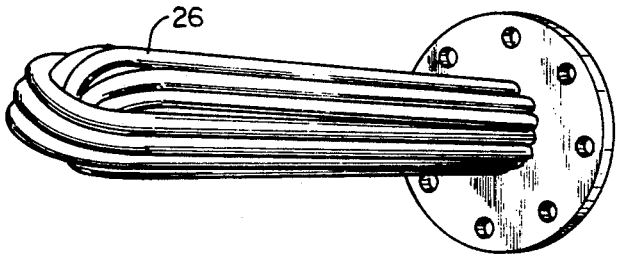
FIG. 4 is a side view in elevation of the heat exchanger coils in the heat exchanger of FIG. 2.

Preferably, as shown in FIGS. 2 to 4, the receiver tank 16 is of elongated cylindrical configuration having a capacity on the order of 15 gallons and is covered with insulation, not shown. A cooling medium is introduced into the receiver tank 16 through an intake manifold 27 via intake line 25 leading from a compressor system 20 which includes a vapor compressor 21, condensor 22, sight glass 23 and thermal expansion valve 24. A series of circumferentially-spaced, generally U-shaped coils 26 are arranged to extend the greater length of the receiver tank 16 and receive the cooling medium in the form of a refrigerant from the thermal expansion valve 24. The intake manifold is partitioned by a horizontal divider plate 28 so that the intake line 25 communicates with the upper inlet ends of the coils 26 above the divider plate 28, and the cooling medium circulates through the lower return ends of the coils 26 below the divider plate 28 which are in communication with the suction line 25' into the vapor compressor 21. A generally cylindrical shroud 48 serves to increase the contact between the refrigerant and the coils 26 within the heat exchanger. Preferably, the cooling medium is a liquid refrigerant, such as, Freon but which is vaporized by the thermal expansion valve 24 to enter the receiver tank 16 at a relatively low temperature and to pass in heat exchange relation to the refrigerant introduced from the source R into the interior of the receiver tank 16.

A bypass conduit 38 also communicates with the inlet line 14 and includes a solenoid valve 34 and crankcase pressure regulator 35. When the solenoid valve 34 is opened in a manner to be described, the refrigerant is directed from the inlet line 14 into a compressor system 30 which is made up of an accumulator 32, heat exchanger 33, vapor compressor 29 and condensor 31. The liquid refrigerant from the condensor 31 is discharged through conduit 40 into a recovery cylinder or tank T, there being a check valve 58 in the conduit 40 together with a solenoid valve 60, suitable filters and dryer cores as represented at 62, and a sight glass 63. Similarly, liquid refrigerant pumped from the receiver tank 16 by the liquid pump 18 is directed through another discharge line 42 which branches into the recovery tank T via the solenoid valve 60. The discharge line 42 has a solenoid valve 41 and a check valve 59. In addition, the discharge conduit 40 may deliver liquid refrigerant from the condensor 31 to the receiver tank 16 via return line 45 which includes a solenoid valve 44 and is connected to the inlet line 14 at a Tee connection 46 into the tank 16. Briefly, when the pressure of the liquid refrigerant in the line 45 is sufficient to close the check valve 15 the receiver tank 16 will receive refrigerant only from the condensor unit 31. Another return line 52 is connected to the outlet line 19 from the receiver tank to return refrigerant from the tank 16 into the bypass line 38 when the solenoid valve 36 is open and the solenoid valve 13 to the liquid pump 18 is closed.

Figure 5:
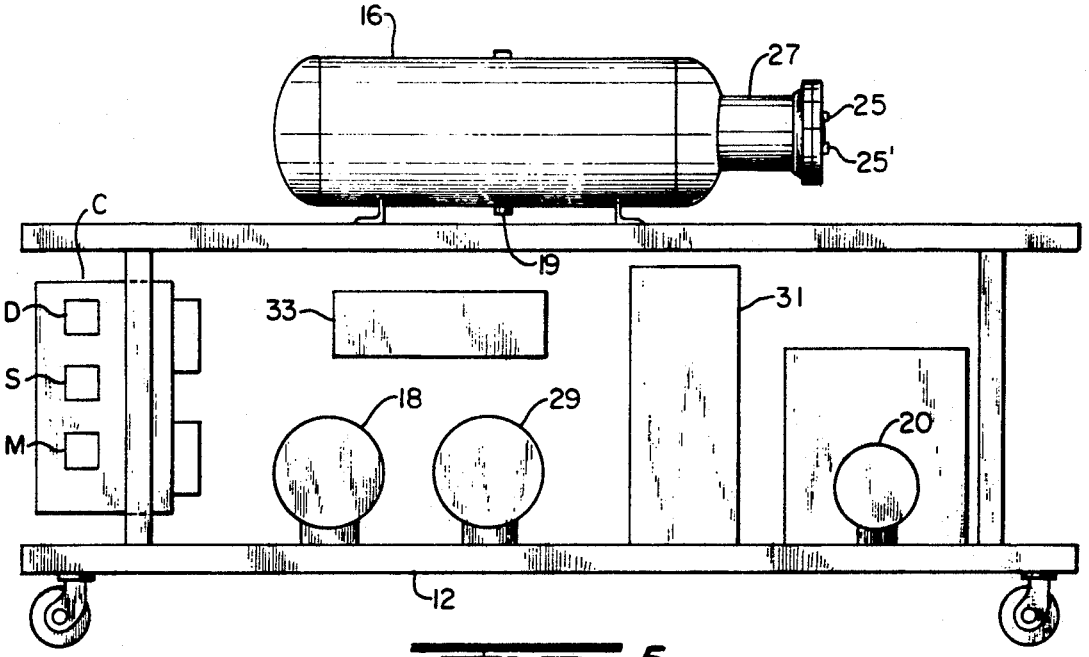
FIG. 5 is a somewhat schematic view illustrating the arrangement of parts of the preferred form of apparatus shown in FIG. 1.

A time delay relay is represented at D on the control panel, as shown in FIG. 5, which is activated when the liquid pump 18 is turned off by the float switch 17. The time delay may be set over a rather broad time range, for example, from 9 to 900 seconds but typically would be set for a time period of less than 4 minutes so that if the liquid pump 18 is turned off by the float switch 17 when the liquid level in the receiver tank is below a designated setting and should remain below that level after the time delay period, the relay would then energize the vapor compressor 29, condensor 31, accumulator 32, heat exchanger 33, solenoid 34 and pressure regulator 35 as well as the solenoid 36. In this way the refrigerant will be returned from the receiver tank 16 through line 52 into the bypass line 38 along with refrigerant from the source R.

In normal operation, a main power switch M on control panel C on the platform 12, as shown in FIG. 5, will energize all control circuits and turn on all of the switches, except for a receiver fill switch S. The receiver 16 is filled with the refrigerant until a predetermined pressure level is reached, for example, on the order of 250 pounds pressure, or refrigerant is observed in the sight glass 50. If there is sufficient refrigerant in the receiver 16 to trip the float switch 17, the liquid pump 18 will turn on and solenoid 41 in the discharge line 42 will be energized together with the compressor system 20 while the solenoids 44, 34 and 36 will be de-energized or returned to a closed position. Refrigerant will enter the receiver tank 16 through the inlet line 14, undergoes cooling as it advances past the heat exchange coils 26 and is then discharged by the liquid pump 18 through the discharge line 42 into the recovery tank T. The float switch 17 continually senses the liquid level and, if the liquid level in the receiver tank drops below a predetermined setting, the float switch will cause the liquid pump 18 to be turned off and the time delay relay D to start running.

As long as the liquid remains at a level high enough to keep the liquid pump 18 cycling, the compressor system 20 will continue to operate in circulating the cooling medium through the receiver tank 16. The condensor 22 will chill the heat exchange cooling medium to a temperature on the order of 40° F., and its thermostatic expansion valve 24 will convert the liquid into vapor as a preliminary to passing through the heat exchange coils 26. Another thermostat 55 at one end of the receiver 16 senses the temperature in the receiver 16 and controls the condensor 22 to turn it on and off according to the temperature level. A pressure relief valve 56 on the receiver tank 16 senses the vapor pressure in the receiver tank 16.

If at the end of the preset time interval of the time delay relay D the liquid level has not returned to reactivate the float switch 17, the liquid pump 18 is turned off and the refrigerant from the source R along with any liquid refrigerant in the receiver 16 are directed through the bypass line 38 as previously described. The vapor compressor system 30 becomes operational, and the refrigerant is then directed through the accumulator 32 by the compressor 29. At the same time, the solenoid 36 in the return line 52 is opened to discharge the refrigerant from the tank 16 through the bypass line 38 to the vapor compressor system 30. The refrigerant is heated to the point of boiling within the accumulator 32 and heat exchanger 33 and then discharged by the compressor 29 back through a separate line 47 from the heat exchanger 33 into the condensor 31. The condensor 31 will completely liquefy the vapor and reduce its temperature to ambient temperature prior to being discharged or delivered through the discharge line 40 to the recovery tank T until the receiver tank 16 is completely empty.

Standard check valves 58 and 59 are provided in the discharge lines 40 and 42, respectively, so that the refrigerant will flow only in the direction of discharge into the recovery tanks T when the solenoid 60 is opened. A weigh scale, not shown, is electrically connected into the main power switch and will close the solenoid 60 as well as to turn off the entire system when the recovery tank T is filled to a predetermined level.

The time delay relay D is preferably a Model 32391 manufactured and sold by Mars of Hauppage, NY and can be manually adjusted at any time to avoid unnecessary delays, for instance, when it is determined that there is insufficient liquid refrigerant to fill the receiver. In this relation, the apparatus of the present invention can be utilized for temporarily draining refrigerant from a system into the receiver or another recovery vessel, for example, when the refrigerant system or source R is being maintained or repaired. For this purpose, in order to fill the receiver tank 16 with refrigerant, the receiver fill switch S on the control panel is turned on and automatically turns off the liquid pump 18 as well as the heat exchanger compressor system 20; also, solenoids 41, 36 and 60 are closed. The discharge line 40, 42 leading into the recovery tank T is connected into the refrigerant source R. Solenoids 34 and 44 in the return line 45 are opened and the vapor compressor 10 is turned on so that the liquid refrigerant from the condensor 31 will return to the intake manifold 27 rather than being directed through the discharge line 40 to the recovery tank T. At the same time, liquid will enter the receiver 16 from the inlet line 14 until the liquid pressure from the condensor 31 is sufficient to overcome the refrigerant pressure from the source R to close the check valve 15. Once the refrigerant source R has been repaired, the liquid pump 18 is energized to direct the liquid refrigerant from the receiver tank 16 back into the refrigerant source R.

Figure 6:
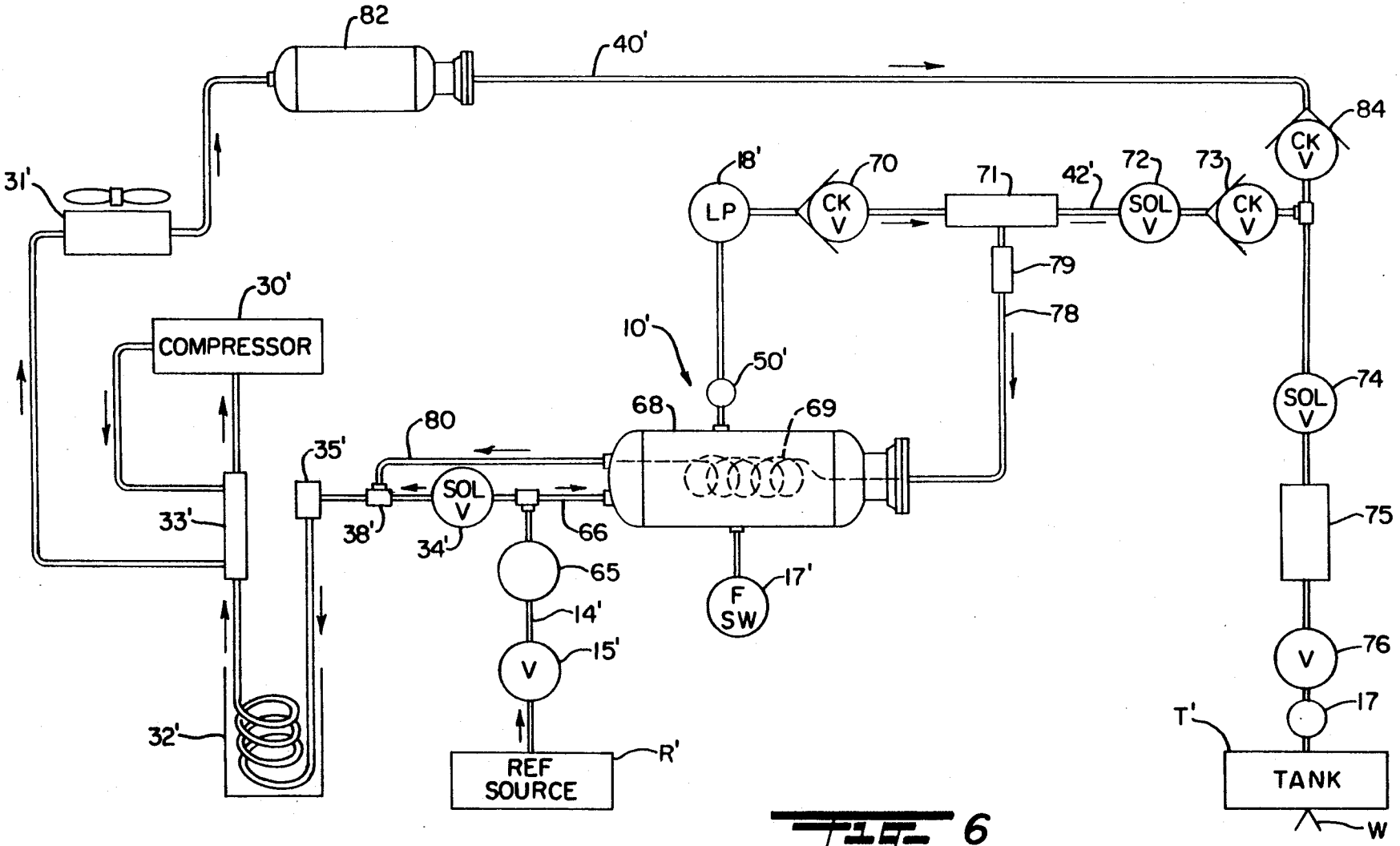
FIG. 6 is a schematic view of a preferred form of low capacity apparatus for reclaiming refrigerant in accordance with the present invention.

A modified form of reclamation system 10' is illustrated in FIG. 6 wherein like parts to those of the preferred form are correspondingly enumerated with prime numerals. The modified form of system 10' permits utilization of the refrigerant being recovered to chill a somewhat modified form of heat exchanger or receiver tank 68, as opposed to the use of a hermetically sealed compressor system 20 of the preferred form, thereby resulting in significant weight and size reduction in the system 10'. The modified form of heat exchanger 68 corresponds to the heat exchanger 16 of the preferred form but is smaller in size and employs a coiled heat exchange tube 69 to direct the cooling medium through the heat exchanger 68, and the cooling medium exits through a conduit 80 from the opposite end of the heat exchanger 68 rather than being recirculated.

The system 10' is connected to a refrigerant source to be drained through an inlet line 14' having a ball valve 15' and a moisture-indicating sight glass 65. The refrigerant enters the heat exchanger 68 through an inlet conduit 66 and fills the tank 68 until the float switch 17' is raised high enough to turn on the liquid pump 18'. A sight glass 50' indicates liquid is in the inlet 19' to the liquid pump 18' and, when the liquid pump 18' is activated, the refrigerant will pass through the check valve 70 to fill the liquid storage tube 71. Solenoid 72 is opened to allow the refrigerant to be pumped through a discharge line 42' leading to the recovery tank T' and which contains check valve 73, solenoid 74, filter 75, a ball valve 76, and a moisture-indicating sight glass 77. In a known manner, the recovery tank or cylinder T' may be placed on a weigh scale W which is electrically connected into the main power switch and will close solenoid 74 and cause the system to turn off when the recovery tank is filled to a preset level.

That refrigerant which collects in the liquid storage tube 71 is free to return through capillary tube 78 to the heat exchange coil 69 in the heat exchanger 68 to act as a cooling medium. A filter dryer 79 in the line 78 filters any contaminant in the refrigerant prior to passing through the tank 68. As the liquid refrigerant enters the heat exchange coil 69 it will expand into a vapor thus cooling the refrigerant in the heat exchanger and is then directed through conduit 80 and crankcase pressure regulator 35' into the vapor compressor section 30'. It is important that the inlet to the pressure regulator 35 be located above the top of the heat exchanger 68. The vapor compressor section 30' operates in the same manner as the compressor section 30 of the preferred form and therefore will not be described in any detail. The liquid refrigerant discharged from the condensor 32' enters a liquid receiver 82 which is in communication with discharge line 40'. The discharge line 40' contains a check valve 84 and is joined into the discharge line 42' upstream of the solenoid 74.

A time delay relay, not shown, on the control panel operates in a similar manner to the time delay relay D of the preferred form to turn off the liquid pump 18' whenever the liquid level in the heat exchanger 68 is not high enough to activate the float switch 17', but will cycle or control the solenoid 34' to turn on and off instead of the compressor 30'. Thus at the end of the preset period of time, the liquid pump 18' will be turned off by the float switch 17' and the solenoid 34' will then open to allow refrigerant to be removed from the source R' and pass through bypass line 38' to the vapor compressor section 30'. It should be noted that solenoid 72 will remain closed when the solenoid 34' is activated to allow the vapor compressor 30' to draw refrigerant from the liquid tube 71 via the capillary tube 78 as well as from the refrigerant source R'.

In the modified system 10' as described, there is a significant reduction in weight and size while at the same time permitting substantially constant removal of refrigerant from the system to be drained. In other words, as long as the liquid storage tube has refrigerant, the receiver tank 68 will continue to operate. On the other hand the modified form of the system is not as efficient as the preferred form at lower ambient conditions and has a significantly lower storage capacity since it does not have a separate cooling system for the heat exchanger 68. For the purpose of illustration but not limitation, the capillary tube 78 would have an inside diameter on the order of 0.040" and the capacity of the liquid storage tube 71 would be on the order of 3 gallons.

It is therefore to be understood that while a preferred and modified form of method and apparatus for the removal and recovery of refrigerant has been herein set forth and described, various other modification and changes may be made without departing from the spirit and scope of the present invention as defined by the appended claims and reasonable equivalents thereof.

I claim:

1. A refrigerant reclamation apparatus for the recovery of refrigerant from a refrigerant source into a refrigerant recovery vessel, comprising:

a first heat exchanger having coolant means for directing a refrigerant cooling medium therethrough, inlet means for directing said refrigerant from said source into said first heat exchanger in heat exchange relation to said cooling medium whereby to cool said refrigerant, and liquid pumping means for discharging said refrigerant from said heat exchanger;

sensing means for sensing the liquid level of said refrigerant in said first heat exchanger, said liquid pumping means being activated in response to said first heat exchanger being filled to a predetermined level for discharging said refrigerant from said heat exchanger into said recovery vessel; and condensor means for condensing refrigerant in gaseous form including means establishing communication between said condensor means and said first heat exchanger for directing said refrigerant from said first heat exchanger to said condensor means.

2. Apparatus according to claim 1, including time delay means responsive to a drop in the liquid level of said refrigerant in said first heat exchanger to cause said sensing means to deactivate said liquid pumping means and activate said condensor means.

3. Apparatus according to claim 1, a vapor compressor system including said condensor means, and accumulator means for heating said refrigerant directed from said first heat exchanger to a temperature level sufficient to convert all of said refrigerant into vapor.

4. Apparatus according to claim 3, said vapor compressor system including second heat exchanger means for receiving the vaporized refrigerant from said accumulator means, compresssor means for directing refrigerant through said second heat exchange means to reduce the temperature of said vaporized refrigerant from said accumulator means, and said condensor means for cooling said vaporized refrigerant from said second heat exchanger means to ambient temperature, and means for discharging said refrigerant from said condensor means selectively to one of said recovery vessel and said refrigerant source.

5. Apparatus according to claim 1, a bypass line establishing communication between said refrigerant source and said first heat exchanger, and time delay means for directing refrigerant from said source through said bypass line a predetermined time interval after said sensing means senses a drop in the liquid level of said refrigerant in said first heat exchanger.

6. Apparatus according to claim 5, including a vapor compressor system having accumulator means for receiving refrigerant from said bypass line and said first heat exchanger and for heating said refrigerant to an elevated sufficient to convert it to a vapor, second heat exchanger means for receiving the vaporized refrigerant from said accumulator means, compressor means for directing a cooling medium through said second heat exchanger means to reduce the temperature of said vaporized refrigerant from said accumulator means, and said condensor means receiving said refrigerant from said second heat exchanger means for cooling said refrigerant to ambient temperature, and means for delivering said refrigerant from said condensor means into said recovery vessel.

7. Apparatus according to claim 1, including first heat exchanger cooling means for directing a cooling medium through said heat exchanger in heat exchange relation to said refrigerant received from said refrigerant source.

8. Apparatus according to claim 7, said first heat exchanger coolant means including a vapor compressor system having condensor means and a thermal expansion valve for directing a refrigerant through said first heat exchanger as the cooling medium.

9. Apparatus according to claim 1, including means for circulating refrigerant from said condensor means to said first heat exchanger until said first heat exchanger is filled to a predetermined level necessary to activate said sensing means.

10. A refrigerant reclamation apparatus for the recovery of refrigerant fluids from a refrigerant source into a recovery vessel, comprising:

a first heat exchanger having coolant means for directing a refrigerant cooling medium therethrough, inlet means for directing refrigerant from said source into said heat exchanger in heat exchange relation to said cooling medium whereby to cool said refrigerant, and liquid pumping means for discharging said refrigerant from said first heat exchanger;

sensing means for sensing the liquid level of said refrigerant in said first heat exchanger, said liquid pumping means activated in response to said first heat exchanger being filled to a predetermined level for discharging said refrigerant from said heat exchanger into said recovery vessel;

condensor means for condensing any refrigerant which is present in gaseous form including means establishing communication between said condensor means and said first heat exchanger for directing said refrigerant from said first heat exchanger to said condensor means;

a bypass line establishing communication between said source and said first heat exchanger, and time delay means for directing refrigerant from said source through said bypass line a predetermined time interval after said sensing means senses a drop in the liquid level of said refrigerant in said first heat exchanger; and first heat exchanger fill means for deactivating said liquid pumping means and opening said bypass line to direct refrigerant from said refrigerant source to said condensor means, and return fluid means for returning the refrigerant from said condensor means to said first heat exchanger means until said refrigerant source is drained.

11. Apparatus according to claim 10, including means for activating said liquid pumping means after said refrigerant source has been drained by said fill means to discharge said refrigerant from said first heat exchanger means back to said refrigerant source.

12. Apparatus according to claim 11, said inlet means directing refrigerant from said source into said first heat exchanger until the pressure of the refrigerant from said condensor means is higher than the pressure of refrigerant from said refrigerant source.

13. Apparatus according to claim 10, including a discharge line from said liquid pumping means and connector means for alternately connecting said discharge line to said recovery vessel or to said refrigerant source.

14. Apparatus according to claim 10, including a vapor compressor system having accumulating means for receiving refrigerant from said bypass line and said first heat exchanger and for heating said refrigerant to an elevated temperature sufficient to convert it to a vapor, second heat heat exchanger means for receiving the vaporized refrigerant from said accumulator means, compressor means for directing a cooling medium through said second heat exchanger means to increase the temperature of said vaporized refrigerant from said accumulator means, and said condensor means receiving said refrigerant from said second heat exchanger means for cooling said refrigerant to ambient temperature, and storage means for recovering said refrigerant from said condensor means.

15. A refrigerant reclamation apparatus for the recovery of refrigerant fluids from a refrigerant source into a recovery vessel, comprising:

a first heat exchanger having coolant means for directing a refrigerant cooling medium therethrough, inlet means for directing refrigerant from said source into said first heat exchanger in heat exchange relation to said cooling medium whereby to cool said refrigerant, liquid pumping means for discharging said refrigerant from said first heat exchanger, and recirculating means for directing a portion of the refrigerant which is present in liquid form from said liquid pumping means as a cooling medium through said heat exchanger;

sensing means for sensing the liquid level of said refrigerant in said first heat exchanger, said liquid pumping means being activated in response to said first heat exchanger being filled with said refrigerant to a predetermined level; and condensor means for condensing any of said refrigerant which is present in gaseous form including means establishing communication between said condensor means and said first heat exchanger for directing said refrigerant from said first heat exchanger to said condensor means.

16. Apparatus according to claim 15, said recirculating means including a liquid storage tube and a capillary tube extending from said storage tube through said first heat exchanger.

17. Apparatus according to claim 15, including a vapor compressor system having accumulator means for receiving said refrigerant from said inlet means and for heating said refrigerant to an elevated temperature sufficient to convert it to a vapor, compressor means having an inlet and an outlet, second heat exchanger means for receiving the vaporized refrigerant from said accumulator means, compressor means for directing said refrigerant from said accumulator means through said second heat exchanger means into said inlet and to return said refrigerant through said outlet into heat exchange relation to said vaporized refrigerant flowing through said second heat exchanger means from said accumulator means whereby to reduce the temperature of said vaporized refrigerant received from said accumulator means, said condensor means receiving said refrigerant from said second heat exchanger means for cooling said refrigerant to ambient temperatures, and means for delivering said refrigerant from said condensor means into said recovery vessel.

* * * * *